US005381812A

United States Patent [19]

Lee

[11] Patent Number: 5,381,812

[45] Date of Patent: Jan. 17, 1995

[54] RAIN WATER COLLECTING DEVICE FOR UMBRELLAS

[76] Inventor: Jun Lee, 58-27 146th St., Flushing, N.Y. 11355

[21] Appl. No.: 65,433

[22] Filed: May 21, 1993

[51] Int. Cl.[6] ..... A45B 25/28

[52] U.S. Cl. ..... 135/48; 135/15.1; 135/44

[58] Field of Search ..... 135/48, 15.1, 16, 33.6, 135/44; D3/17

[56] References Cited

U.S. PATENT DOCUMENTS

| | | | |
|---|---|---|---|
| D. 21,590 | 5/1892 | Runkle | 135/48 |
| D. 190,615 | 6/1961 | Davis | 135/48 |
| 218,508 | 8/1879 | Ellis | 135/48 |
| 257,305 | 5/1882 | Emery | 135/48 |
| 288,889 | 11/1883 | Susman | 135/48 |
| 406,020 | 7/1889 | Beach | 135/48 |
| 1,373,642 | 4/1921 | Pomfret | 135/48 |
| 2,838,058 | 6/1958 | Foltis et al. | 135/48 |
| 3,809,107 | 5/1974 | Liu | 135/48 |
| 4,703,768 | 11/1987 | Lee | 135/48 |
| 5,111,835 | 5/1992 | Lin . | |
| 5,161,560 | 11/1992 | Sheu . | |
| 5,178,175 | 1/1993 | Lin . | |

FOREIGN PATENT DOCUMENTS

| | | | |
|---|---|---|---|
| 218729 | 8/1957 | Australia | 135/48 |
| 309412 | 7/1933 | Italy | 135/48 |

*Primary Examiner*—Carl D. Friedman
*Assistant Examiner*—Wynn Wood

[57] ABSTRACT

An inexpensive rain water collecting device which is easy to manufacture. The rain water collecting device provides an effective device which is adaptable to various umbrella tip sizes and avoids any bacterial growth problems. The rain water collecting device includes at least a reservoir having a first open end and a second open end, the first open end has an opening with an inner perimeter which is substantially equal to an outer perimeter of the umbrella tip, and the second open end has an opening with a perimeter which is greater than the inner perimeter of the opening of the first open end; a ferrule formed about the opening of the first open end; and at least one flow barrier about the second open end of the reservoir. After using an umbrella in the rain, it is collapsed. The rain water on the cloth of the umbrella then drains into the reservoir of the rain water collecting device. The flow barrier(s) prevent the rain water contained in the reservoir from splashing out while the collapsed umbrella (although pointed substantially downward) is moved about.

16 Claims, 1 Drawing Sheet

RAIN WATER COLLECTING DEVICE FOR UMBRELLAS

BACKGROUND OF THE INVENTION

1. Field of the Invention

The present invention relates to a rain water collecting device and, more particularly, to a rain water collecting device which attaches to an umbrella tip so as to collect rain water when the umbrella is folded after use.

2. Description of the Related Art

Umbrellas are very useful articles during rainy days. However, one nagging problem is the rain water which remains on the cloth of the umbrella. After using an umbrella in the rain, a user usually collapses their umbrella and then goes inside a building carrying the collapsed umbrella. The rain water which remains on the cloth of the umbrella then drips on the floor of the building which has been entered. As a result, slippery floor conditions and/or water damage to the flooring or carpeting may result.

Several solutions to this problem have been proposed in the past, but none completely satisfies the users needs. U.S. Pat. No. 5,161,560 to Sheu describes a sponge inside a reservoir which attaches to an umbrella tip. One problem with this solution is that bacterial growth will likely occur in the sponge.

U.S. Pat. No. 5,178,175 to Lin describes a complicated rain water collecting device. The device includes a reservoir, a diaphragm mounted in the reservoir to separate the reservoir into first and second compartments, a receiving member for receiving an umbrella tip, a first coil tube mounted in the first compartment, and a second coil tube mounted in the second compartment. When the umbrella is collapsed after use, the rain water remaining on the cloth of the umbrella drains into the first compartment via the first coil tube. For draining the rain water collected in the reservoir, the umbrella is turned upside down so as to allow the rain water in the first compartment to drain outside via the second coil tube. Although this device may be effective in preventing umbrellas from dripping water on the floor, it is a complicated device which is both difficult and expensive to manufacture.

Thus, there is a need for a rain water collecting device for umbrellas which can be inexpensively produced yet still prevent rain water from dripping on the floor without any bacterial growth problems.

SUMMARY OF THE INVENTION

Broadly speaking, the invention is an inexpensive rain water collecting device which is affixed to the tip of an umbrella.

In an embodiment of the invention, the rain water collecting device includes at least a reservoir having a first open end and a second open end, the first open end has an opening with an inner perimeter which is substantially equal to an outer perimeter of the umbrella tip, and the second open end has an opening with a perimeter which is greater than the inner perimeter of the opening of the first open end; a ferrule formed about the opening of the first open end; and at least one flow barrier about the second open end of the reservoir. After using an umbrella in the rain, it is collapsed. The rain water on the cloth of the umbrella then drains into the reservoir of the rain water collecting device. The flow barrier(s) prevent the rain water contained in the reservoir from splashing out while the collapsed umbrella (although pointed substantially downward) is moved about. Preferably, the flow barrier(s) are fib(s).

An important advantage of the invention is that it provides an effective and easily manufacturable device which is adaptable to various umbrella tip sizes and avoids any bacterial growth problems.

BRIEF DESCRIPTION OF THE DRAWINGS

The invention will be more clearly understood from the following description in conjunction with the accompanying drawings, wherein.

DETAILED DESCRIPTION OF THE INVENTION

Embodiments of the invention are discussed below with reference to FIGS. 1–2. However, those skilled in the art will readily appreciate that the detailed description given herein with respect to these figures is for explanatory purposes as the invention extends beyond these limited embodiments.

Figure 1:
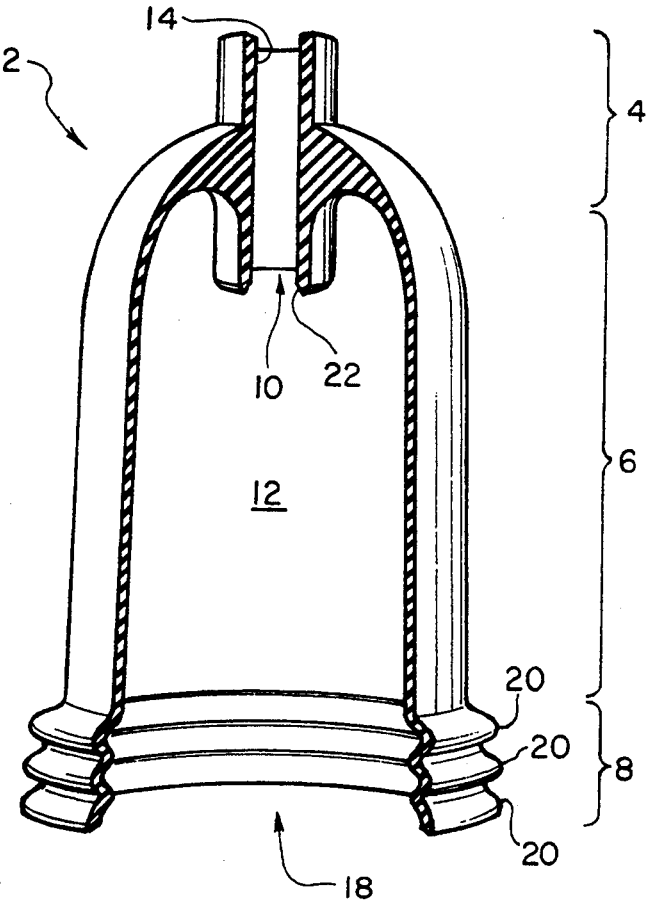
FIG. 1 is a perspective view of a rain water collecting device according to an embodiment of the invention.

FIG. 1 is a perspective view of an embodiment of a rain water collecting device 2 according to an embodiment of the invention. The rain water collecting device 2 includes three sections: a top section 4, a reservoir section 6 and a ribbed section 8.

The top section 4 is closed except for an opening 10 through the center portion of the top section 4. The opening 10 extends through the top section 4 to a reservoir 12 which is formed by the reservoir section 6. The reservoir 12 collects the rain water when the umbrella is folded or collapsed after being used in the rain.

The top section 4 also forms a ferrule 14 about the opening 10. FIG. 2 illustrates a cross-sectional view of the rain water collecting device shown in FIG. 1. As shown in FIG. 2, a tip 16 of an umbrella passes through the center of the entire rain water collecting device 2. The ferrule 14 snugly holds the rain water collecting device 2 to the tip 16 of an umbrella. In addition, the ferrule 14 prevents any rain water held in the reservoir 12 from leaking out onto the floor or carpeting via the opening 10 when an umbrella tip 16 is inserted therein. Thus, the rain water collecting device 2 fits on umbrella tips 16 of various sizes.

The ribbed section 6 is formed as the base of the reservoir section 8 and has an opening 18. The opening 18 allows rain water remaining on the cloth of a wet and collapsed umbrella to drain into the reservoir 12.

The ribbed section 6 includes a series of ribs 20. The ribs 20 are preferably circular channels at the base of the reservoir section 6. After rain water has collected in the reservoir 12 from the cloth (e.g., panel or gore) of the wet and collapsed umbrella, the ribs 20 act as flow barriers so as to prevent the water contained within the reservoir 12 from splashing out of the reservoir while the collapsed umbrella (although pointed substantially downward) is moved about as the user walks about or otherwise moves his/her hand which holds the umbrella. Moreover, the ribs 20 of the ribbed section 8 may also be used to make the base of the rain water collecting device 2 more flexible so that it can be compressed as may be needed when the umbrella is fully opened.

Preferably, the rain water collecting device is integrally formed of a plastic material. As a result, the rain water collecting device according to the invention can be inexpensively produced using a single mold with no assembly required. In addition, the inner most portion of the ferrule 14 which extends into the reservoir 12 is preferable flared-out 22 so as to more easily receive the tip 16 of the umbrellas.

Figure 2:
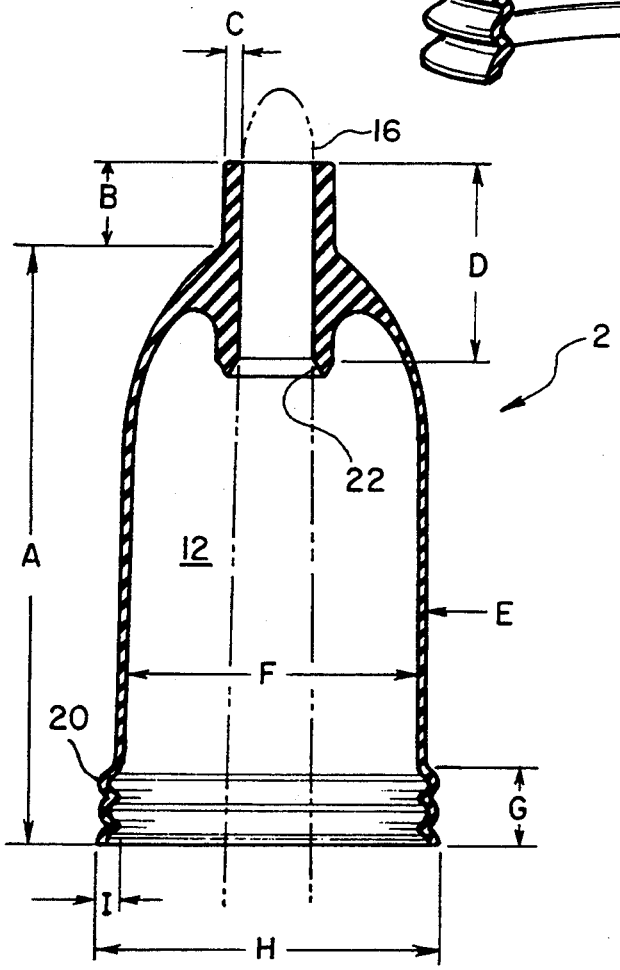
FIG. 2 is a cross-sectional view of the rain water collecting device shown in FIG. 1.

Moreover, the preferable dimensions of the rain water collecting device 2 shown in FIG. 2 are contained in Table 1.

TABLE 1

| Label | Inches |
|---|---|
| A | 2 9/16 |
| B | 7/16 |
| C | 3/32 |
| D | ⅞ |
| E | 3/64 |
| F | 1⅛ |
| G | 11/16 |
| H | 1½ |
| I | 3/16 |

Tests have shown that when these dimensions are used, the reservoir 12 will fill to 70% of its capacity on days where the rain is heavy. However, the amount of rain water which drains into the reservoir 12 is a function of how heavy the rain is and the surface area of the cloth of the umbrella.

To drain the water collected in the reservoir 12, the umbrella together with the rain water collecting device 2 are turned upside down so as to allow the rain water to drain. Alternatively, the rain water collecting device 2 can be detached from the umbrella tip 16 to drain the rain water which previously collected in the reservoir 12.

The many features and advantages of the present invention are apparent from the written description and thus it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A water collecting device for use with an umbrella having an umbrella tip, said rain water collecting device comprising:

a reservoir having a first open end and a second open end, the first open end has an opening with an inner perimeter which is substantially equal to an outer perimeter of the umbrella tip, and the second open end has an opening with a perimeter which is greater than the inner perimeter of the opening of the first open end, said reservoir including a rain water collection region for collecting rain water and a rain water retention region for retaining the rain water within the rain water collection region when the umbrella is other than opened and upright;

a ferrule formed about the opening of the first open end, said ferrule including an outer portion which extends out away from said reservoir and an inner portion which extends into said reservoir, and where an inner most portion of the inner portion is flared out so as to facilitate insertion of the umbrella tip into said ferrule; and a plurality of flow barriers within the rain water retention region and about the second open end of said reservoir.

2. A water collecting device as recited in claim 1, wherein said device is plastic and manufactured as a unitary device.

3. A water collecting device as recited in claim 1, wherein the first and second openings are circular.

4. A water collecting device as recited in claim 1, wherein each of said flow barriers comprises a rounded rib.

5. A water collecting device as recited in claim 4, wherein said rib is circular.

6. A water collecting device as recited in claim 1, wherein each of said flow barriers comprises a rounded rib.

7. A water collecting device as recited in claim 6, wherein said ribs facilitate deformation of the second open end of said reservoir.

8. A water collecting device as recited in claim 1, wherein said ribs facilitate compression of the second open end of said reservoir.

9. A rain water collecting device for use with an umbrella having an umbrella tip, said rain water collecting device comprising:

a reservoir having a first open end and a second open end, the first open end having an opening with a circumference which is substantially equal to the circumference of the umbrella tip, and the second open end has an opening with a circumference which is greater than the circumference of the opening of the first open end, said reservoir including a rain water collection region for collecting rain water and a rain water retention region for retaining the rain water within the rain water collection region when the umbrella is other than opened and upright;

affixing means for affixing said rain water collecting device to the umbrella tip via the opening in the first open end while preventing any water which may be contained in said reservoir from leaking out from around the umbrella tip, said affixing means including a tubular outer portion extending out away from said reservoir and a tubular inner portion extending into said reservoir, and where an inner most portion of the tubular inner portion is flared out so as to facilitate insertion of the umbrella tip into said affixing means; and at least one rib about the second open end of said reservoir.

10. A rain water collecting device as recited in claim 9, wherein said rib has a depth of about 3/16 of an inch.

11. A rain water collecting device as recited in claim 9, wherein said reservoir has a height of about 2 9/16 of an inch.

12. A rain water collecting device as recited in claim 9, wherein said device is plastic and manufactured as a unitary device.

13. A rain water collecting device as recited in claim 9, wherein the first and second openings are circular.

14. A rain water collecting device as recited in claim 9, wherein said device comprises a plurality of ribs.

15. A rain water collecting device as recited in claim 14, wherein said ribs facilitate deformation of the second open end of said reservoir.

16. A rain water collecting device as recited in claim 14, wherein said ribs facilitate compression of the second open end of said reservoir.

* * * * *